US007124511B2

(12) United States Patent
Hamada et al.

(10) Patent No.: US 7,124,511 B2
(45) Date of Patent: Oct. 24, 2006

(54) RAZOR BLADE

(75) Inventors: Tadashi Hamada, Sakai (JP); Shinji Fujimoto, Neyagawa (JP); Shigetoshi Sakon, Hirakata (JP); Takashi Kozai, Inukami-gun (JP)

(73) Assignee: Matsushita Electric Works, Ltd., Kadoma (JP)

( * ) Notice: Subject to any disclaimer, the term of this patent is extended or adjusted under 35 U.S.C. 154(b) by 11 days.

(21) Appl. No.: 10/478,209

(22) PCT Filed: May 27, 2002

(86) PCT No.: PCT/JP02/05113

§ 371 (c)(1),
(2), (4) Date: Nov. 28, 2003

(87) PCT Pub. No.: WO02/098619

PCT Pub. Date: Dec. 12, 2002

(65) Prior Publication Data

US 2004/0143975 A1 Jul. 29, 2004

(30) Foreign Application Priority Data

May 28, 2001 (JP) ..... 2001-159627

(51) Int. Cl.
*B26B 21/58* (2006.01)
*B26B 21/56* (2006.01)

(52) U.S. Cl. ..... 30/346.53; 30/346.57; 30/350

(58) Field of Classification Search ..... 30/50, 30/41.7, 350, 346.53, 346.54, 346.55, 346.57, 30/355; 76/104.1
See application file for complete search history.

(56) References Cited

U.S. PATENT DOCUMENTS

| | | | | |
|---|---|---|---|---|
| 1,489,419 | A * | 4/1924 | Beechlyn | 30/348 |
| 4,875,288 | A | 10/1989 | Trotta et al. | 30/49 |
| 5,018,274 | A * | 5/1991 | Trotta | 30/50 |
| 5,317,938 | A * | 6/1994 | de Juan et al. | 76/104.1 |
| 5,842,387 | A * | 12/1998 | Marcus et al. | 76/104.1 |
| 5,983,756 | A | 11/1999 | Orloff | 76/104.1 |
| 6,009,623 | A * | 1/2000 | Orloff | 30/41.7 |
| 6,216,345 | B1 * | 4/2001 | Andrews | 30/50 |
| 6,615,496 | B1 * | 9/2003 | Fleming et al. | 30/350 |
| 2002/0066186 | A1 * | 6/2002 | White et al. | 30/50 |

FOREIGN PATENT DOCUMENTS

| | | | |
|---|---|---|---|
| DE | 35 26 951 | * | 1/1987 |
| EP | 0 541 723 | | 12/1997 |
| FR | 2 577 240 | * | 8/1986 |
| GB | 1393611 | | 5/1975 |
| JP | 3062484 | * | 7/1999 |
| JP | 2000-94564 | | 4/2000 |
| JP | 2001-123203 | | 5/2001 |
| JP | 2002-11690 | * | 1/2002 |

* cited by examiner

*Primary Examiner*—Hwei-Siu Payer
(74) *Attorney, Agent, or Firm*—Oblon, Spivak, McClelland, Maier & Neustadt, P.C.

ABSTRACT

(57)

A razor blade is provided, which achieves improved safety in use and reduced cutting resistance to an object to be cut such as beard and hair, as compared with conventional razor blades. This razor blade can be obtained by using, as a silicon thin sheet, a single crystal silicon material such as Si wafer or a polycrystalline silicon material including relatively large silicon crystal grains, forming at least one opening in the silicon thin sheet by chemical etching, and forming a cutting edge made of silicon single crystal by ion beam etching without machining such that the cutting edge projects into the opening and has a nose radius of 0.5 μm or less, and preferably 0.1 μm or less.

15 Claims, 6 Drawing Sheets

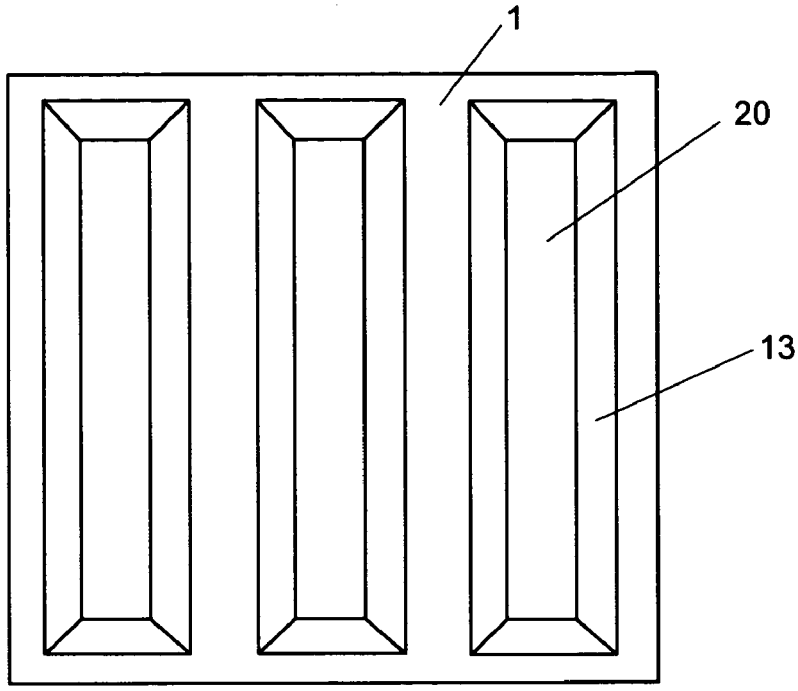
FIG. 2
FIG. 3A
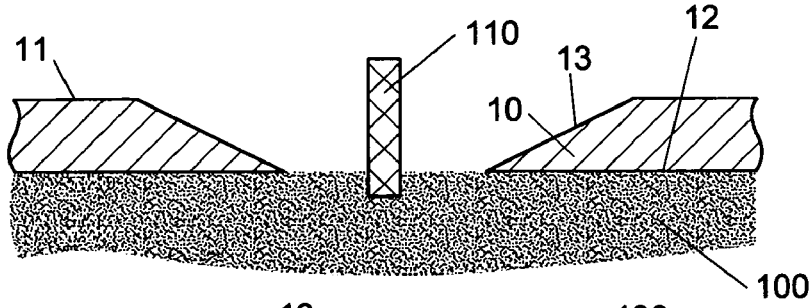
FIG. 3B
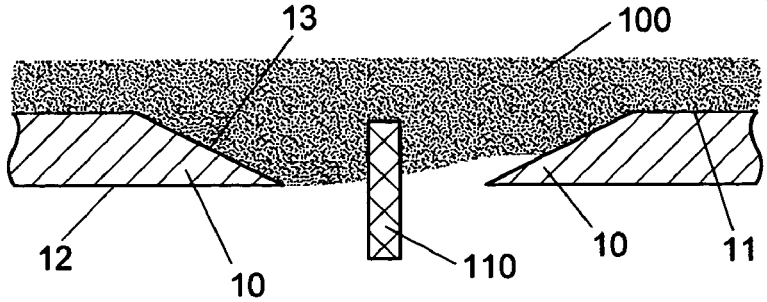

RAZOR BLADE

TECHNICAL FIELD

The present invention relates to a razor blade, which is excellent in safety and cutting performance for an object to be cut such as beard and hair, and particularly the razor blade having a cutting edge, which is made of a silicon single crystal and has an extremely small nose radius.

BACKGROUND ART

Conventional razor blades with a cutting edge linearly formed along a side of a thin steel sheet may accidentally cause injury to skin in use. Therefore, it is a major task to improve the safety. For example, it has been proposed to reduce the damage to the skin by winding a plurality of thin wires around the razor blade at regular intervals. However, from the viewpoint of improving the safety, while maintaining excellent cutting performance for an object to be cut such as beard and hair, a satisfactory level has not been always achieved.

In addition, various kinds of net blades have been proposed to achieve a further improvement in safety. For example, such net blades are disclosed in U.S. Pat. No. 4,875,288 and European Patent No. 0 541 723 B1. In the case of a net blade made of a metal material, however, since its cutting edge is formed by machining, there is a limitation with respect to the formation of the cutting edge with a small nose radius. For example, even when burrs generated at the cutting edge by grinding are removed by precise polishing such as lapping, it is difficult to obtain a nose radius of 1 μm or less. Due to this reason, it has not been achieved yet to smoothly shave beard or hair by the net blade made of a stainless steel except for a razor blade with a linear cutting edge of a nose radius of approximately 0.1 μm, which is obtained by grinding a stainless steel sheet. Moreover, in the conventional razor blades on the market, a technique of forming the cutting edge of a nose radius of 0.1 μm or less has not been sufficiently established yet.

SUMMARY OF THE INVENTION

Therefore, a primary concern of the present invention is to provide a razor blade with a cutting edge of a nose radius (R) of 0.5 μm or less, which has the capability of providing remarkably improved safety in use, and a reduction in cutting resistance to an object to be cut such as beard and hair, as compared with conventional razor blades.

That is, the razor blade of the present invention is made of a silicon thin sheet having at least one opening and a cutting edge projecting into the opening, and wherein the cutting edge is made of silicon single crystal, and a nose radius of the cutting edge is 0.5 μm or less, and particularly 0.1 μm or less.

In the razor blade described above of the present invention, it is preferred that the silicon thin sheet is a silicon single crystal material such as Si wafer. In this case, as described below, it is possible to efficiently manufacture a net-like razor blade or a razor blade having a plurality of slits by silicon micromachining technique.

In addition, it is preferred that the razor blade according to a preferred embodiment of the present invention is a net blade made of the silicon thin sheet having a plurality of openings and the cutting edge projecting into each of the openings. Alternatively, it is preferred that the razor blade is made of the silicon thin sheet having a plurality of openings and the cutting edge projecting into each of the openings, and each of the openings is configured in a rectangular shape, which is arranged in substantially parallel with an adjacent opening in its longitudinal direction.

These and still other objects and advantages of the present invention will become more apparent from the best mode for carrying out the invention explained in details below, referring to the attached drawings.

BRIEF EXPLANATION OF THE DRAWINGS

FIG. 2 is a top view of a razor blade according to another preferred embodiment of the present invention;

FIGS. 3A and 3B are schematic diagrams illustrating shaving operations with use of the razor blade of the present invention;

BEST MODE FOR CARRYIG OUT THE INVENTION

A razor blade of the present invention has a cutting edge of silicon single crystal, which is formed by silicon micromachining technique with use of a silicon single crystal material such as Si wafer or a polycrystalline silicon material including relatively large silicon crystal grains, without applying mechanical grinding or polishing. The silicon micromachining technique means a technique of forming an ultra-fine three-dimensional structure by a physical etching such as ion-beam etching, a chemical etching (anisotropic etching), or a combination thereof.

In general, single crystal has a long-range order in atomic arrangement, and also a long-range order in direction dependency of bonding between atoms (covalent bonding between silicon atoms). Therefore, an intersection between planes of atomic arrangements, i.e., the intersection between crystal planes is maintained over the long range. By using this intersection as a cutting edge, it is possible to theoretically form the cutting edge with an extremely small nose radius (R). Such an ultra-fine cutting edge can be achieved by an ultra-microfabrication using the above-described silicon micromachining technique. Moreover, a single-crystal cutting edge of the razor blade can be formed by stacking silicon atoms one by one to form the intersection between the atomic arrangements, which is included in the technical concept of the present invention.

By the way, an interest of the present invention is not to provide a simple razor blade having a plurality of fine openings. That is, as described above, the present invention has been achieved by finding that the cutting edge made of silicon single crystal, which is formed so as to project into each of the openings (blade openings), and have a nose radius of 0.5 μm or less, preferably 0.1 μm or less in consideration of single crystal properties of Si, provides excellent cutting performance as well as the safety in use.

As described, the razor blade of the present invention can be manufactured by using the silicon micromachining technique. Concretely, it is preferred to adopt at least one of chemical etching and ion-beam etching utilized to fabricate silicon in the semiconductor technical field. To satisfy both of the manufacturing efficiency and the required precision to the cutting edge, a preferred manufacturing method is introduced below. That is, at least one opening is formed in a silicon thin sheet by the chemical etching, and then the cutting edge made of silicon single crystal is formed so as to project into the opening and have a nose radius of 0.5 μm or less by the ion-beam etching.

Figure 1A:
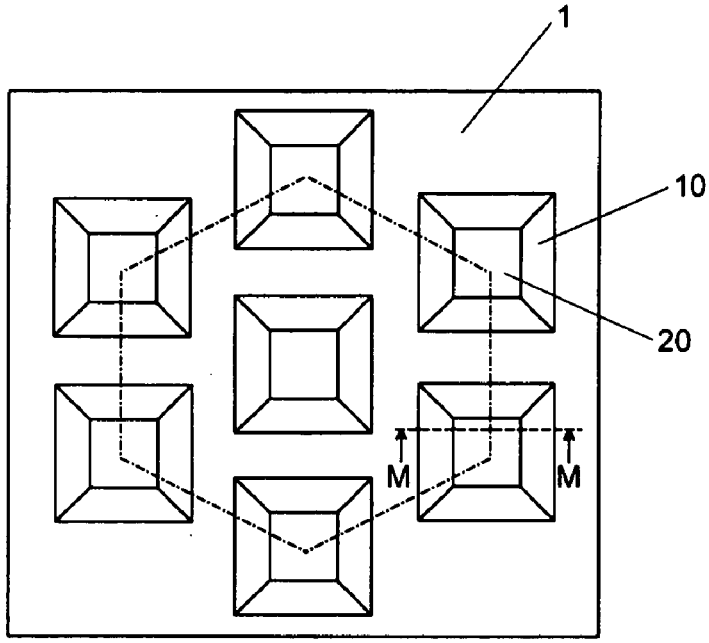
FIG. 1A is a top view of a razor blade according to a preferred embodiment of the present invention.

In addition, the razor blade of the present invention has at least one opening, into which the cutting edge projects. In practical use, a plurality of openings can be formed in various kinds of patterns. For example, a net blade 1 shown in FIGS. 1A and 1B can be obtained by forming a plurality of opening 20 in a Si wafer as the silicon thin sheet at a required pattern such that a cutting edge 10 projects into each of the opening 20. In this case, each of the openings 20 is configured in a substantially square shape. The cutting edge is provided at each of the four sides of the square opening. Therefore, it is possible to get a shave by moving the razor blade in any direction of 360 degrees. FIG. 1C is a SEM photograph of the cutting edge of the razor blade.

In addition, as shown in FIG. 2, when a plurality of openings 20 are formed at the required pattern in the silicon thin sheet, it is preferred that each of the openings is of a rectangular shape, which is arranged in substantially parallel with an adjacent opening in its longitudinal direction. In this figure, the cutting edges are provided at all of four sides of the rectangular opening. Alternatively, the cutting edges may be provided only at the opposite two sides extending in the longitudinal direction.

Figure 1B:
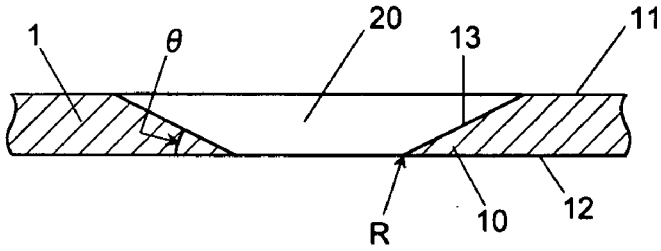
FIG. 1B is a partially cross-sectional view taken along the line M—M of FIG. 1A.
Figure 1C:
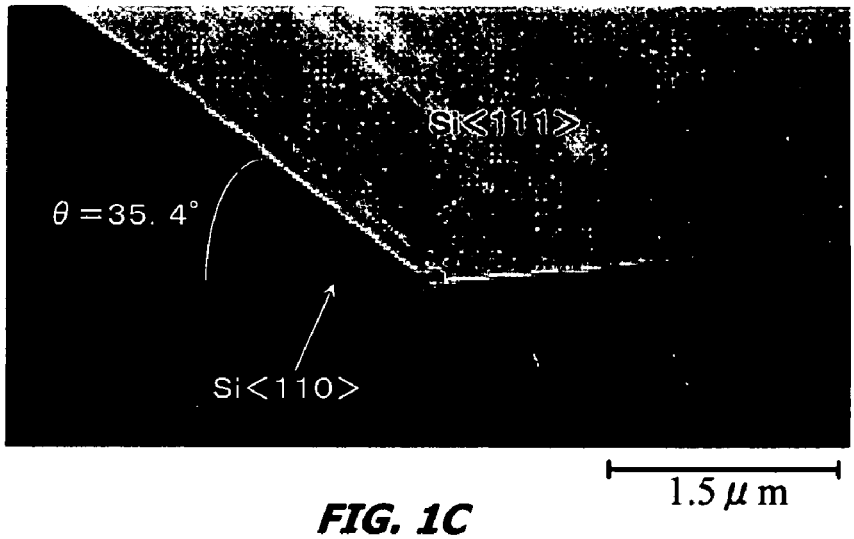
FIG. 1C is a SEM photograph of a cutting edge of the same razor blade.

It is also preferred that a cutting edge angle (θ), which is defined between a bottom surface 12 of the razor blade and an inclined surface 13 extending from a top surface 11 to the bottom surface 12 of the razor blade in the opening 20, as shown in FIG. 1B, is within a range of 10° to 45°, and preferably 20° to 35°. In this range, it is possible to provide better cutting performance during the shaving process. For example, in the case of cutting a beard 110, while allowing the bottom surface 12 of the razor blade to closely contact the skin 100, as shown in FIG. 3A, the beard can be cut at its root by the sharp cutting edge 10. On the other hand, in the case of cutting the beard 110, while allowing the top surface 13 of the razor blade to closely contact the skin 100, as shown in FIG. 3B, close shaving can be achieved by the sharp cutting edge 10 because the beard is dragged up in the blade opening 20, as in the case of using an electric shaver. There is no limitation with respect to the thickness of the silicon thin sheet used to form the razor blade. Therefore, when the rigidity of the razor blade is needed, a relatively thick silicon sheet can be used. On the other hand, a relatively thin silicon sheet (for example, approximately 35 μm) may be used to form the razor blade for close shaving.

Figure 4A:
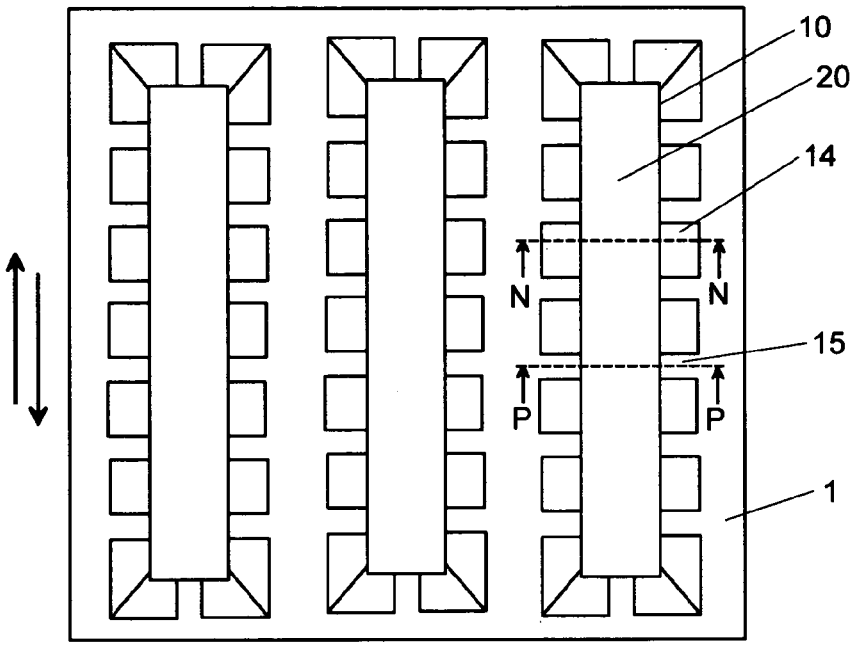
FIG. 4A is a top view of a razor blade according to another preferred embodiment of the present invention.
Figure 4B:
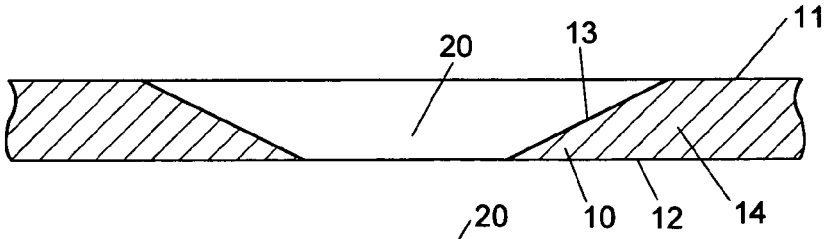
FIG. 4B is a partially cross-sectional view taken along the line N—N of FIG. 4A.
Figure 4C:
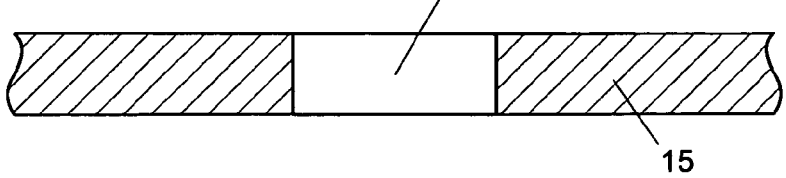
FIG. 4C is a partially cross-sectional view taken along the line P—P of FIG. 4A.

In addition, it is preferred that the cutting edge 10 formed in the longitudinal direction of the opening 20 is composed of cutting-edge forming portions 14 and cutting-edge free portions 15, which are arranged in a staggered manner, as shown in FIG. 4A. FIG. 4B shows a cross section of the cutting-edge forming portion 14, and FIG. 4C shows a cross section of the cutting-edge free portion 15. In this case, even when the razor blade is moved in a direction parallel with the cutting edge 10 by mistake during the shaving process, as shown by the arrows in FIG. 4A, it is hard to cut the skin. Therefore, it is effective to achieve a further improvement in safety of the razor blade of the present invention. As understood from examples described below, such a cutting-edge structure can be designed and manufactured with comparative ease by use of the silicon micromachining technique.

Figure 5A:
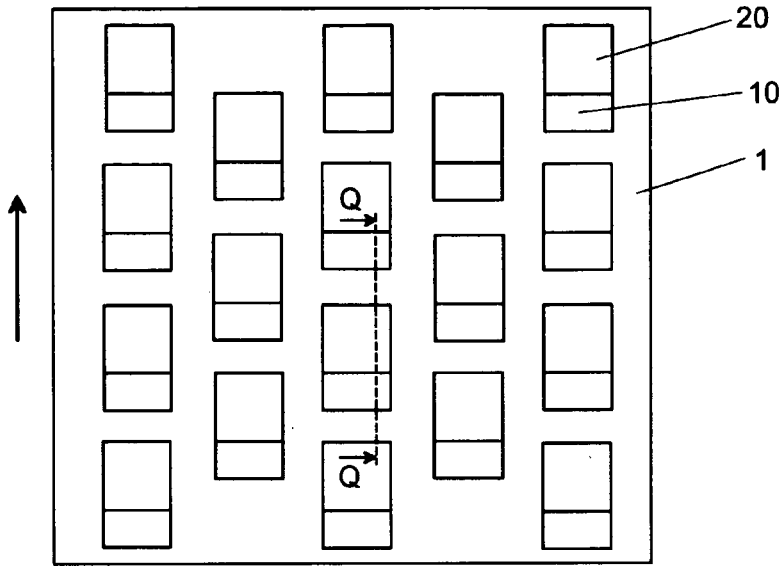
FIG. 5A is a top view of a razor blade according to another preferred embodiment of the present invention.
Figure 5B:
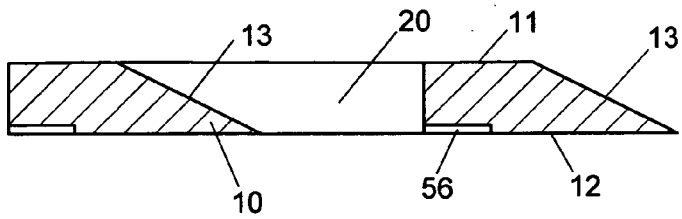
FIG. 5B is a partially cross-sectional view taken along the line Q—Q of FIG. 5A.

As shown in FIGS. 5A and 5B, it is preferred that each of the openings 20 is of a rectangular shape, and the cutting edge 10 is formed only at one side of the rectangular opening 20. In this case, the beards can be cut by traveling the razor blade in a direction shown by the arrow in FIG. 5A. Therefore, although the traveling direction of the razor blade is limited, the rigidity of the razor blade can be increased due to a reduction of the cutting-edge forming portions. In addition, since the openings can be arranged in a higher density, it is possible to increase an open-area ratio of the razor blade.

Figure 6A:
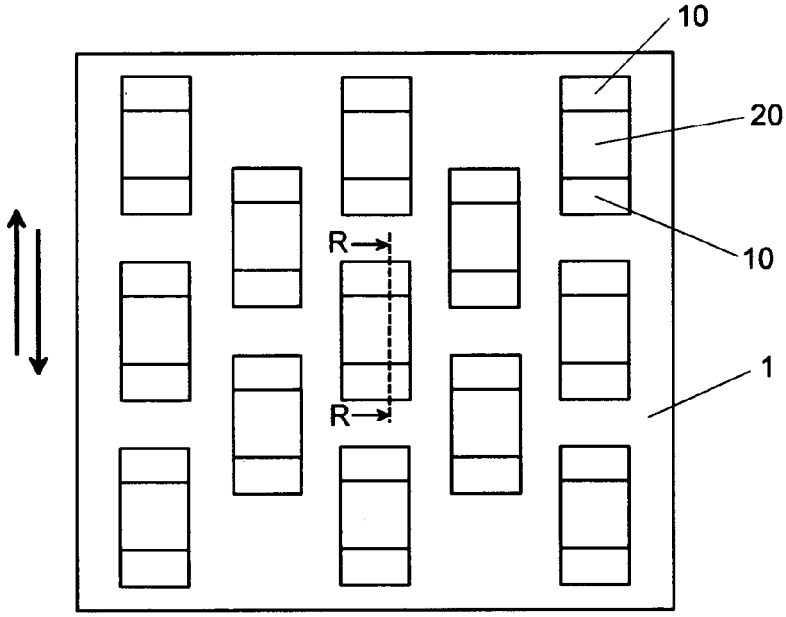
FIG. 6A is a top view of a razor blade according to still another preferred embodiment of the present invention.
Figure 6B:
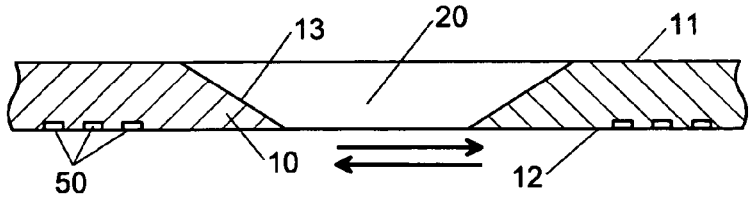
FIG. 6B is a partially cross-sectional view taken along the line R—R of FIG. 6A.

Alternatively, as shown in FIGS. 6A and 6B, it is preferred that each of the openings 20 is of a rectangular shape, and the cutting edges 10 are formed only at opposite two sides of the rectangular opening. In this case, the beards can be cut by traveling the razor blade 1 in two directions (go and return directions) shown by the arrows in FIG. 6A. Therefore, although the traveling direction of the razor blade is limited, the rigidity of the razor blade can be increased due to a reduction of the cutting-edge forming portions. In addition, since no cutting edge is formed in a direction substantially parallel to the traveling direction of the razor blade, it is possible to arrange the openings in a higher density, and therefore provide the razor blade having an increased open-area ratio.

Figure 7A:
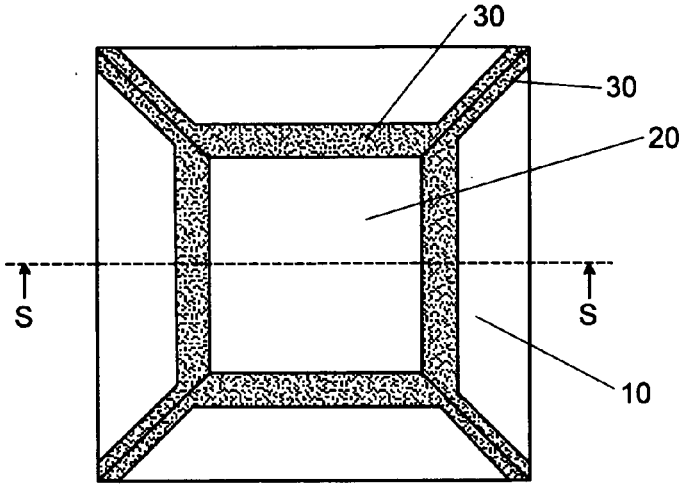
FIG. 7A is a top view of a surface layer formed on a cutting edge of the razor blade of the present invention.
Figure 7B:
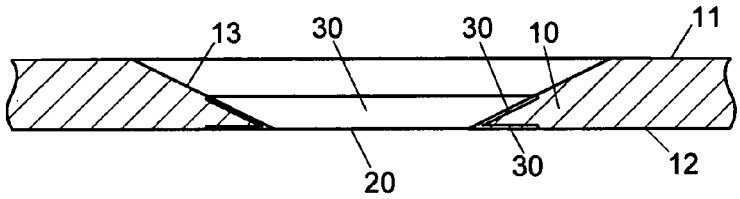
FIG. 7B is a partially cross-sectional view taken along the line S—S of FIG. 7A.

It is also preferred that a surface layer 30 formed on the cutting edge 10 of the razor blade of the present invention is provided with a silicon oxide layer, at least one of metal and alloy layers, or an amorphous silicon layer. In particular, as shown in FIGS. 7A and 7B, it is preferred that the surface layer 30 is formed at a required region spreading from the bottom surface 12 of the razor blade to the inclined surface 13 in the opening 20 through the nose (R), and at intersection regions between adjacent inclined surfaces 13 in the opening 20 (=regions including an intersection line of the inclined surfaces having different crystal orientations). In the case of forming the surface layer 30 on the cutting edge 10, it is preferred that a thickness of the surface layer is not greater than 10 nm to maintain the nose radius of 0.1 μm or less of the cutting edge.

When the silicon oxide layer is formed as the surface layer 30, it is possible to improve resistance to breakage such as cracks resulting from a local stress orientation totally or partially induced in the razor blade during the shaving process. For example, when the opening 20 is of a substantially square shape, the inclined surfaces intersect to each other by 90° in the opening. The silicon oxide layer can be formed along this intersection line. When the silicon oxide layer is formed on a surface of the razor blade that contacts the skin in use, the cutting resistance between the skin and the razor blade decreases. Thus, the razor blade becomes gentle to skin. The silicon oxide layer can be formed in the outermost surface of the razor blade by means of selective oxidation of silicon.

In addition, the metal layer or the alloy layer may be formed as the surface layer 30. For example, the surface layer can be formed by a physical deposition of one of metals having excellent ductility and corrosion resistance such as Au, Pt, Ni, Ti and Al or an alloy thereof. As in the above-described case, it is possible to improve the resistance to breakage such as cracks resulting from a local stress orientation totally or partially induced in the razor blade during the shaving process. Alternatively, in place of the silicon oxide layer, the amorphous silicon layer may be formed. For example, the amorphous silicon layer can be formed by remelting and quenching with laser-beam irradiation, an irradiation damage method using electron beam, neutron beam or the like, or ion implantation.

In addition, a polycrystalline silicon layer may be formed in a region other than the nose (R) of the cutting edge. The polycrystalline silicon layer can be formed by controlling the parameters in a similar method to the case of forming the amorphous silicon layer. When the polycrystalline silicon layer is formed on the cutting edge, there is a fear that micro-chipping occurs at the grain boundary. However, when the polycrystalline silicon layer is formed in the region other than the nose (R), it is possible to increase the resistance to breakage such as large cracks of the razor blade.

Figure 8A:
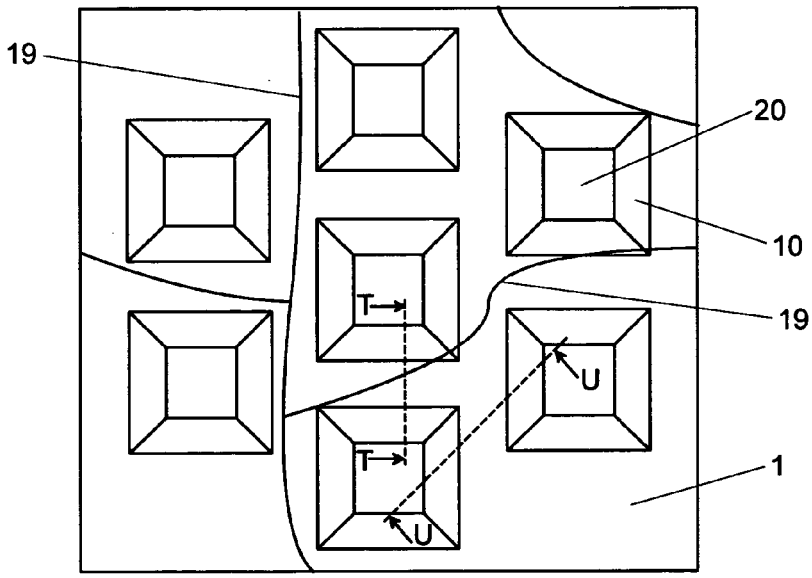
FIG. 8A is a top view of a razor blade according to a preferred embodiment of the present invention.
Figure 8B:
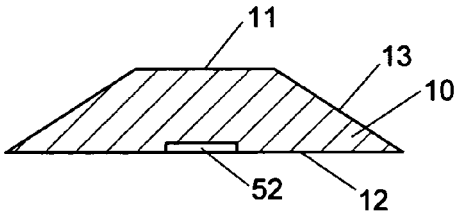
FIG. 8B is a partially cross-sectional view taken along the line T—T of FIG. 8A.
Figure 8C:
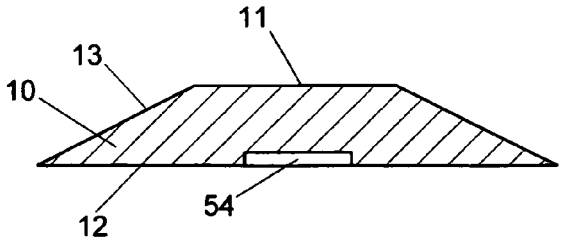
FIG. 8C is a partially cross-sectional view taken along the line U—U of FIG. 8A.

It is also preferred to form microscopic asperities in a surface of the razor blade 1, which contacts the user's skin in use, except for the vicinity of the cutting edge. In this case, due to a reduction in contact area between the razor blade and the skin during the shaving process, it is possible to smoothly get a shave. In addition, as shown in FIGS. 8A to 8C, slots (52, 54) may be formed at required positions in the bottom surface of the razor blade, i.e., the surface of the razor blade that contacts the skin in use to reduce the contact area between the razor blade and the skin during the shaving process. Moreover, to facilitate an induction of the object to be cut into the opening 20, it is preferred to from a groove in the surface of the razor blade that contacts the skin in use. For example, as shown in FIG. 5B, when the cutting edge is formed only at one side of the rectangular opening, it is preferred to form the groove 56 at the opposite side of the cutting edge 10 through the opening 20. Since grown beards are smoothly induced into the openings 20, it is possible to efficiently cut the grown beards by the cutting edge provided at the opposite side of the groove 56.

Figure 9A:
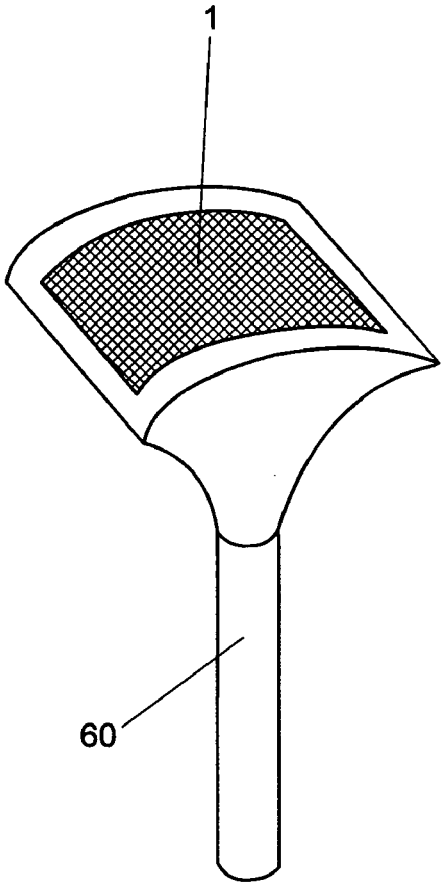
FIGS. 9A and 9B are perspective views illustrating the razor blades of the present invention mounted on various kinds of bodies.
Figure 9B:
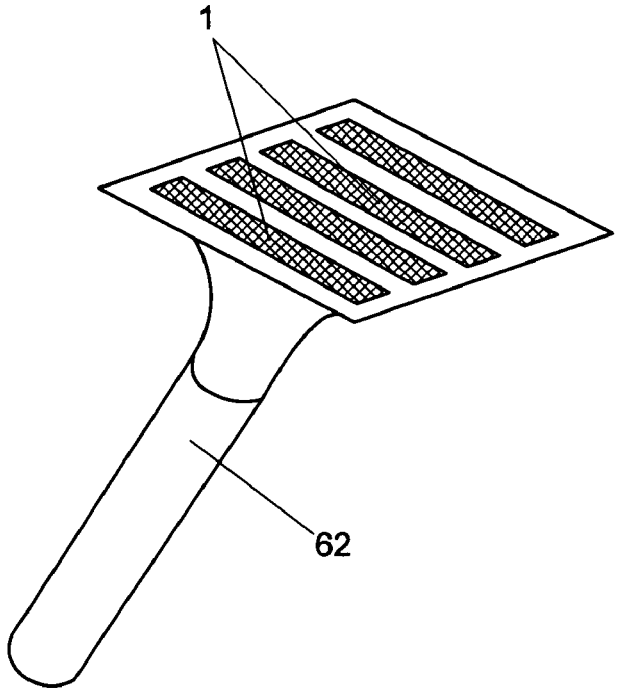

As shown in FIGS. 9A and 9B, the razor blade 1 of the present invention can mounted on various kinds of bodies (60, 62) with use of a dedicated jig or an adhesive. Alternatively, the razor blade may be used for an electric shaver (not shown) having a means of giving microvibrations to the razor blade 1. Since the microvibrations of the razor blade efficiently lead the grown beards into the openings (blade openings), it is possible to speedily smoothly finish the shaving process. In addition, a pressure sensor (not shown) may be attached to at least one of the openings of the razor blade. When the razor blade is pressed against the skin at an excessive pressure, it is possible to give a caution to the user by alarm sound and so on. Therefore, even when amounts of the beards dragged up from the skin into the openings excessively increases, it is possible to avoid an inconvenience such as injury of the skin, and thereby achieve a further improvement of the safety in use.

EXAMPLE 1

A polycrystalline silicon block having a crystal grain size of approximately 10 mm was cut to obtain a sheet-like silicon single crystal having the thickness of 0.3 mm and the square shape of 7 mm×7 mm. Then, square openings (blade openings) having the size of 1.5 mm×1.5 mm were formed in a pattern shown in FIG. 1A by chemical etching. Next, cutting edges 10 were formed in each of the openings 20 by ion-beam etching with argon so as to have a cutting edge angle of 20° and project into the opening 20. In this case, the cutting edges 10 were formed at all of the four sides of the square opening 20. A center-to-center distance between adjacent blade openings is 2.0 mm. The blade openings are arranged according to a closest packing manner in the same plane. As shown by the dotted line in FIG. 1A, centers of adjacent three openings are positioned at vertexes of a regular triangle having a side of 0.7 mm.

From a SEM observation of the cutting edge 10 of the obtained razor blade 1, it was confirmed that the nose radius (R) of the cutting edge is smaller than 10 nm. The cutting resistance in the case of cutting a single hair was 1 gf. On the other hand, the cutting resistance in the case of cutting the single hair by use of a commercially available razor blade having a cutting edge angle of approximately 20° was 10 gf. Thus, it was confirmed that the razor blade of this example is one-tenth smaller in cutting resistance than the commercially available razor blade. In addition, five of the same razor blades were arranged in parallel, and then mounted on a required body by use of an adhesive. A shaving process was performed, while these razor blades being pressed against the skin. Since the size of the square opening is very small, smooth shaving was achieved without causing any injury of the skin.

EXAMPLE 2

A polycrystalline silicon block having a crystal grain size of approximately 10 mm was cut to obtain a sheet-like silicon single crystal having the thickness of 0.3 mm and the square shape of 7 mm×7 mm. Then, rectangular openings (blade openings) having the size of 1.5 mm×5 mm were formed in a pattern shown in FIG. 2 by chemical etching. Next, cutting edges 10 were formed in each of the rectangular openings by ion-beam etching with argon to have a cutting edge angle of 20° and project into the rectangular opening 20. In this case, the cutting edges 10 were formed at all of four sides of the rectangular opening. A center-to-center distance between adjacent openings is 2.0 mm.

From a SEM observation of the cutting edge 10 of the obtained razor blade, it was confirmed that the nose radius (R) of the cutting edge is smaller than 10 nm. As in the case of Example 1, the razor blade of this Example was compared to the commercially available razor blade with regard to the cutting resistance in the case of cutting the single hair. As a result, it was confirmed that the razor blade of this Example is one-tenth smaller in the cutting resistance than the commercially available razor blade. In addition, three of the razor blades were arranged in parallel, and mounted on a required body by use of a dedicated jig. A shaving process was performed, while these razor blades being pressed against the skin. Since the size of the square opening is very small, smooth shaving was achieved without causing any injury of the skin.

EXAMPLE 3

By cutting a (100) single crystal silicon block into a thin sheet, a Si wafer having the thickness of 0.3 mm was obtained. Then, square openings (blade openings) having the size of 1.5 mm×1.5 mm were formed in a pattern shown in FIG. 1A by chemical etching (selective etching) of (111) plane. In this case, a cutting edge 10 having the cutting edge angle of 35.4° was obtained by an intersection between the (110) plane and the (111) plane (FIG. 1C). From a SEM observation of the cutting edge 10 of the obtained razor blade, it was confirmed that the nose radius (R) of the cutting edge is smaller than 10 nm. The cutting resistance in the case of cutting a single hair by this razor blade was 3 gf. On the other hand, the cutting resistance in the case of cutting the single hair by a commercially available razor blade having the cutting edge angle of approximately 20° was 10 gf. Thus, the razor blade of this Example is smaller in the cutting resistance than the commercially available razor blade. In addition, there was no occurrence of injury of the skin during the shaving process. Furthermore, as shown in FIG. 3B, a shaving experiment was carried out under a wet condition by allowing the top surface 11 of the razor blade 1 to contact the skin. As a result, beards were cut at their roots, and a cutting surface of each of the beards was substantially normal to the length direction. Moreover, since the cutting edge is provided at all of four sides of the square opening, it was possible to get a shave by moving the razor blade in any direction.

In addition, an electric shaver having the capability of providing microvibrations of this razor blade at an amplitude of approximately 0.2 mm and a frequency of vibration of 50 Hz was experimentally manufactured. Due to the microvibrations of the razor blade, it was possible to lead grown beards having relatively long lengths into the blade openings with reliability and efficiently cut the beards. As a safety device, a pressure sensor was mounted in one of the blade openings of the razor blade. In this case, it is possible to detect a pressure value at the time of pressing the razor blade against the skin. Therefore, when the razor blade was pressed against the skin at an excessive pressure, it was possible to give a caution to the user by an alarm sound.

As an additional experiment of this Example, a silicon oxide layer having the thickness of 10 nm was formed in a bottom surface 12 of the razor blade that contacts the skin in use. As a result of performing a shaving test, while allowing the bottom surface 12 of the razor blade to contact the skin, as shown in FIG. 3A, it was confirmed that the friction between the bottom surface of the razor blade and the skin decreases by about 40%, as compared with the case of not having the silicon oxide layer.

EXAMPLE 4

A polycrystalline silicon block having a crystal grain size of approximately 10 mm was cut to obtain a sheet-like silicon single crystal having the thickness of 0.3 mm and the square shape of 7 mm×7 mm. Then, rectangular openings (blade openings) having the size of 1.5 mm×10 mm were formed in a pattern shown in FIG. 2 by chemical etching. After masking a region that the formation of cutting edges is not intended, a step of forming the cutting edges 10 by ion-beam etching with argon was performed, so that cutting edge forming portions 14, where cutting edges are formed, and cutting edge free portions 15, where there is no cutting edge, are formed in a staggered manner in the longitudinal direction of the rectangular opening, as shown in FIG. 4A. In this case, the size in the longitudinal direction of the cutting edge forming portion 14 is 0.5 mm, and the size in the longitudinal direction of the cutting edge free portion 15 is 0.3 mm. A cutting edge angle of the formed cutting edge is 20°. A center-to-center distance between adjacent openings (blade openings) is 2.0 mm.

From a SEM observation of the cutting edge 10 of the obtained razor blade 1, it was confirmed that the nose radius (R) of the cutting edge is smaller than 10 nm. In this Example, since the cutting edge forming portions 14 and the cutting edge free portions 15 are arranged in the staggered manner along the longitudinal direction of the rectangular opening, injury of the skin was not caused by traveling the razor blade 1 in a direction parallel with the cutting edge, even when the size in the longitudinal direction of the opening increased.

EXAMPLE 5

By cutting a (110) single crystal silicon block into a thin sheet, a Si wafer having the thickness of 0.3 mm was obtained. Then, square openings (blade openings) having the size of 0.6 mm×0.6 mm were formed in a pattern shown in FIG. 1A by chemical etching (selective etching) of the (111) plane. In this case, a cutting edge 10 having the cutting edge angle of 35.4° was obtained at an intersection between the (110) plane and the (111) plane. From a SEM (scanning electron microscope) observation of the cutting edge, it was confirmed that a nose radius (R) of the cutting edge is smaller than 10 nm. In the case of performing a (wet) shaving test under a wet condition, while allowing the razor blade to contact the skin, as shown in FIG. 3B, beards were dragged out from the skin in the blade openings, so that close shaving was achieved.

EXAMPLE 6

By cutting a (110) single crystal silicon block into a thin sheet, a Si wafer having the thickness of 0.3 mm was obtained. Then, square openings (blade openings) having the size of 1.5 mm×1.5 mm were formed in a pattern shown in FIG. 5A by chemical etching (selective etching) of the (111) plane. In this Example, to form a cutting edge only at one side of the square opening 20, a masking treatment was performed at the remaining three sides thereof. Next, a cutting edge forming step was performed by ion-beam etching with argon, so that a cutting edge 10 having the cutting edge angle of 35.4° was obtained at an intersection between the (110) plane and the (111) plane. From a SEM (scanning electron microscope) observation of the cutting edge, it was confirmed that a nose radius (R) of the cutting edge is smaller than 10 nm. In the present Example, a traveling direction of the razor blade during the shaving process is limited to a single direction. However, it is easy to obtain the rigidity of the razor blade. In addition, it is possible to increase an open-area ratio of the net blade by decreasing a distance between adjacent blade openings. A shaving test was performed by use of this razor blade under a wet condition. As a result, good shaving performance was achieved without causing any injury of the skin during the shaving process.

EXAMPLE 7

By cutting a (110) single crystal silicon block into a thin sheet, a Si wafer having the thickness of 0.3 mm was obtained. Then, square openings (blade openings) having the size of 1.5 mm×1.5 mm were formed in a pattern shown in FIG. 6A by chemical etching (selective etching) of the (111) plane. In this Example, to form cutting edges 10 only at opposite sides of the square opening 20, a masking treatment was performed at the remaining two sides thereof. Next, a cutting edge forming step was performed by ion-beam etching with argon, so that a cutting edge 10 having the cutting edge angle of 35.4° was obtained at an intersection between the (110) plane and the (111) plane. From a SEM (scanning electron microscope) observation of the cutting edge, it was confirmed that a nose radius (R) of the cutting edge is smaller than 10 nm. In the present Example, the traveling direction of the razor blade during the shaving process is limited to two directions (go and return directions). However, as in the case of Example 6, it is easy to obtain the rigidity of the razor blade. In addition, it is possible to increase an open-area ratio of the net blade by decreasing a distance between adjacent blade openings. A shaving test was performed by use of this razor blade under a wet condition. As a result, good shaving performance was achieved without causing any injury of the skin during the shaving process.

EXAMPLE 8

Selective oxidation was performed to a razor blade 1 manufactured according to the same method as Example 3. That is, as shown in FIGS. 7A and 7B, silicon was selectively oxidized in the vicinity of the cutting edge and at an intersecting portion between the inclined surfaces 13 constructing the cutting edges. A thickness of the oxide layer is approximately 10 nm. From a SEM observation of the cutting edge 10, it was confirmed that the nose radius (R) of the cutting edge is still smaller than 10 nm. By the formation of this oxide layer, about 20% increase in strength of the razor blade was achieved, as compared with the case of not forming the oxide layer.

EXAMPLE 9

A vacuum deposition of gold (Au) was performed on a razor blade manufactured according to the same method as Example 3. That is, as shown in FIGS. 7A and 7B, a gold layer having the thickness of 20 nm was deposited in the vicinity of the cutting edge and at an intersecting portion between the inclined surfaces constructing the cutting edges (the boundary between adjacent inclined surfaces). From a SEM observation of the cutting edge 10, it was confirmed that the nose radius (R) of the cutting edge is approximately 15 nm. By the formation of the deposited metal layer, about 40% increase in strength of the razor blade was achieved, as compared with the case of not forming the metal layer.

EXAMPLE 10

An electron irradiation treatment was performed to a razor blade manufactured according to the same method as Example 3. That is, as shown in FIGS. 7A and 7B, an amorphous silicon layer having the thickness of approximately 10 nm was formed in the vicinity of the cutting edge and at an intersecting portion between inclined surfaces constructing the cutting edges (the boundary between adjacent inclined surfaces). The electron irradiation was done under conditions of 2 MeV and $10^{22}/cm^2 \cdot sec$. From a SEM observation of the cutting edge 10, it was confirmed that the nose radius (R) of the cutting edge is still smaller than 10 nm. By the formation of this amorphous silicon layer, about 40% increase in strength of the razor blade was achieved, as compared with the case of not forming the amorphous silicon layer.

EXAMPLE 11

An electron irradiation treatment was performed to a razor blade manufactured according to the same method as Example 3. That is, as shown in FIGS. 7A and 7B, a polycrystalline silicon layer having the thickness of approximately 10 nm was formed in required regions of a bottom surface and inclined surfaces other than the nose (R) of the cutting edge. The electron irradiation was done under conditions of 2 MeV and $10^{19}/cm^2 \cdot sec$. From a SEM observation of the cutting edge 10, it was confirmed that the nose radius (R) of the cutting edge is still smaller than 10 nm. By the formation of this polycrystalline silicon layer, about 30% increase in strength of the razor blade was achieved, as compared with the case of not forming the polycrystalline silicon layer.

EXAMPLE 12

As shown in FIG. 6B, recesses 50 having the depth of 0.05 mm and the width of 0.05 mm were formed in required regions other than the vicinity of the cutting edge of a bottom surface that contacts the skin in use of the razor blade manufactured according to the same method as the Example 7. An interval between adjacent recesses is 0.1 mm. Thus, asperities were formed in the bottom surface of the razor blade. A shaving test was performed, while allowing the razor blade 1 to contact the skin. As a result, the fiction between the bottom surface of the razor blade and the skin decreased by about 30%, as compared with the case of not forming the recesses.

EXAMPLE 13

As shown in FIGS. 8B and 8C, slots 52, 54 having the depth of 0.05 mm were formed in a bottom surface 12 that contacts the skin in use of the razor blade 1 manufactured according to the same method as the Example 3. A width of the respective slot is equal to about a half of a top surface 11 between adjacent blade openings. A shaving test was performed, while allowing the razor blade 1 to contact the skin. As a result, the friction between the bottom surface of the razor blade and the skin decreased by about 40%, as compared with the case of not forming those slots. In this Example, in place of using the thin sheet of silicon single crystal, a polycrystalline silicon thin sheet, which includes a plurality of silicon single crystal grains each having a sufficient size to obtain the cutting edge 10 of silicon single crystal, was used. In FIG. 8A, the numeral 19 designates a grain boundary between adjacent silicon single crystal grains. Thus, in the case of using the polycrystalline silicon thin sheet, it is necessary to consider the position of the grain boundary between the silicon single crystal grains in order to determine the arrangement of the openings 20. However, this Example suggests that the razor blade of the present invention can be manufactured by using the polycrystalline silicon thin sheet other than the thin sheet of silicon single crystal.

EXAMPLE 14

As shown in FIG. 5B, a groove 56 having the required width of 0.05 mm was formed at the opposite side of the cutting edge 10 through the opening 20 in a bottom surface 12 that contacts the skin in use of the razor blade 1 manufactured according to the same method as the Example 6. A shaving test was performed, while allowing this razor blade 1 to contact the skin. As a result, the friction between the bottom surface of the razor blade and the skin decreased by about 40%, as compared with the case of not forming the groove. In addition, since the formation of the groove facilitated leading grown beards into the openings 20, the beards were efficiently cut by the cutting edge 10 formed at the opposite side of the groove through the opening.

Example Comparative 1

A polycrystalline silicon block composed of fine silicon crystal grains, by which a cutting edge made of silicon single crystal can not be obtained, was cut to a polycrystalline thin sheet having the thickness of 0.3 mm and the square shape of 7 mm×7 mm. Then, square openings having the size of 1.5 mm×1.5 mm were formed in the same pattern shown in FIG. 1A by chemical etching. Next, by ion-beam etching with argon, cutting edges 10 having the cutting edge angle of 20° were formed so as to project into the respective opening. In this case, a center-to-center distance between adjacent blade openings is 2.0 mm.

From a SEM observation of the cutting edge of the obtained razor blade, it was confirmed that the cutting edge is made of polycrystalline silicon, and recesses are formed at the grain boundary of the polycrystalline silicon by micro chipping. As a result, a sharp cutting edge was not obtained.

Example Comparative 2

Square openings (blade openings) having the size of 1.5 mm×1.5 mm were formed in a stainless steel sheet having the thickness of 35 μm by machining. In addition, cutting edges having the cutting edge angle of 30° were formed so as to project in each of the openings. Subsequently, quenching was performed to the obtained razor blade to obtain the Vickers's hardness (Hv) of 650. A surface of this razor blade that contacts the skin in use was polished. From a SEM observation of the cutting edge, it was confirmed that a nose radius (R) of the cutting edge is approximately 1 μm. A shaving test was performed by use of this razor blade under a wet condition. As a result, good cutting performance was not obtained because of an insufficient cut of the cutting edge in the beard. In addition, an injury of the skin occurred during the shaving test.

INDUSTRIAL APPLICABILITY

According to the present invention, at least one opening, and preferably a plurality of openings is formed in a silicon thin sheet of silicon single crystal or polycrystalline silicon including relatively large silicon crystal grains. Then, a cutting edge made of silicon single crystal is formed without depending on machining so as to project into the opening and have a nose radius is 0.5 μm or less, and preferably 0.1 μm or less. Therefore, the razor blade can provide an improved safety by preventing the occurrence of an accident such as an injury of the skin caused by mistake, and remarkably reduced cutting resistance for hair or beard, as compared with conventional razor blades.

The invention claimed is:

1. A razor blade comprising:

a silicon thin sheet having a plurality of openings and a cutting edge projecting into each of said openings, wherein said cutting edge is made of silicon single crystal, a nose radius of said cutting edge is 0.5 μm or less, each of said openings has a rectangular shape and is arranged in substantially parallel with an adjacent one of said openings, said cutting edge is provided at a longitudinal side of each of said openings and has cutting-edge forming portions and cutting-edge free portions, and said cutting-edge forming portions and said cutting-edge free portions of said cutting edge are arranged in a staggered manner in said longitudinal direction of said openings.

2. The razor blade as set forth in claim 1, wherein said silicon thin sheet is made of a silicon single crystal.

3. The razor blade as set forth in claim 1, wherein the nose radius of said cutting edge is 0.1 μm or less.

4. The razor blade as set forth in claim 1, wherein said razor blade is a net blade made of said silicon thin sheet and said cutting edge projecting into each of said openings.

5. The razor blade as set forth in claim 1, wherein said cutting edge extends in the longitudinal direction of each of said openings.

6. The razor blade as set forth in claim 1, wherein a cutting-edge angle, which is defined between a bottom surface of said razor blade and an inclined surface extending in said opening from a top surface of said razor blade to said bottom surface, is within a range of 10 degrees to 45 degrees.

7. The razor blade as set forth in claim 1, wherein said cutting edge is formed only at a single side of said opening.

8. The razor blade as set forth in claim 1, wherein said cutting edge is formed only at opposed two sides of said opening.

9. The razor blade as set forth in claim 1 wherein said cutting edge has an amorphous silicon layer thereon.

10. The razor blade as set forth in claim 1, comprising a polycrystalline silicon layer formed at a region other than a nose of said cutting edge.

11. The razor blade as set forth in claim 1, comprising microscopic asperities in a surface of the razor blade, to which a skin contacts in use.

12. The razor blade as set forth in claim 1, wherein a slot is formed in a bottom surface of the razor blade, to which a skin contacts in use, and has a shape of reducing contact resistance between the skin and the razor blade.

13. The razor blade as set forth in claim 1, wherein a slot is formed in a surface of the razor blade, to which a skin contacts in use, and has a shape of facilitating an introduction of an object to be cut into said opening.

14. The razor blade as set forth in claim 1, wherein the razor blade comprises a silicon oxide layer formed on a surface of the razor blade, to which a skin contacts in use.

15. The razor blade as set forth in claim 1, wherein said cutting edge has a silicon oxide layer thereon.

* * * * *